United States Patent [19]

Johnson

[11] Patent Number: 4,716,883

[45] Date of Patent: Jan. 5, 1988

[54] HIGH EFFICIENCY INFRARED RADIANT ENERGY HEATING SYSTEM AND METHOD OF OPERATION THEREOF

[76] Inventor: Arthur C. W. Johnson, 2611 Lake Charnwood, Troy, Mich. 48084

[21] Appl. No.: 860,902

[22] Filed: May 8, 1986

[51] Int. Cl.[4] ..... F24H 3/00

[52] U.S. Cl. ..... 126/116 A; 126/85 R; 431/6

[58] Field of Search ..... 126/85 R, 85 A, 91 A, 126/92 B, 374, 351, 110 E, 116 A, 116 C, 39 G; 431/6; 236/10, 46 E, 46 F; 237/70; 165/18

[56] References Cited

U.S. PATENT DOCUMENTS

| | | | |
|---|---|---|---|
| 2,952,409 | 9/1960 | Mattheus | 236/10 |
| 4,053,279 | 10/1977 | Eichenlamb | 126/92 C X |
| 4,298,165 | 11/1981 | McKinley | 236/46 F X |
| 4,390,125 | 6/1983 | Rozzi | 237/70 |
| 4,403,942 | 9/1983 | Copenhaner | 126/116 A X |
| 4,502,625 | 3/1985 | Mueller | 236/46 E X |

FOREIGN PATENT DOCUMENTS

| | | | |
|---|---|---|---|
| 2076996 | 12/1981 | United Kingdom | 236/46 E |

*Primary Examiner*—Larry Jones
*Attorney, Agent, or Firm*—Krass & Young

[57] ABSTRACT

A low intensity infrared radiant heating system comprising an exhaust effluent temperature sensor for disabling burner operations to keep thermal operating efficiences within preselected limits. A minimum burner run timer is used to avoid corrosive condensate accumulation in the primary emitter length. Multiple burner systems utilizing a microprocessor control system is disclosed.

18 Claims, 2 Drawing Figures

HIGH EFFICIENCY INFRARED RADIANT ENERGY HEATING SYSTEM AND METHOD OF OPERATION THEREOF

INTRODUCTION

This invention relates to low intensity infrared radiant heating systems of the type in which the infrared emitter is a metal tube which is charged with hot gaseous effluent by means of one or more fuel fired burners. More particularly the invention relates to method and apparatus for substantially increasing the operating effectiveness of such a system.

BACKGROUND OF THE INVENTION

Low intensity radiant infrared heating systems of the type described above are preferred in many applications because of the high thermal heating efficiency and effective utilization which can be realized. An advantage of the radiant energy system is the fact that it is not used to directly heat the air of the enclosure in which it is placed; rather, the infrared source emits radiation which is absorbed by humans, animals, plants in the heated area. In addition, a concrete floor under an infrared emitter will absorb frequencies within the emission spectrum of the system and thereafter release thermal energy to make the enclosure more comfortable and healthful for its inhabitants on an economical basis. Low intensity infrared systems have the further advantage of high directionality and the ability to be placed where needed, thus increasing effective utilization.

It is unavoidable, however, that such heating systems suffer from inefficiencies due to what have previously been perceived as necessary operating conditions. I have found that it is not necessary to compromise efficiency on the basis of certain heretofore accepted operating conditions and this discovery forms the basis for one aspect of my invention hereinafter described.

The hot gaseous effluent of low intensity infrared radiant energy heating systems is typically highly acidic and, therefore, corrosive to system components when cooled to dew point or condensation levels; i.e., the odor producing additives, for example, in natural gas include sulfur and the oxidation of sulfur in the presence of moisture produces sulfuric acid. Accordingly it is generally believed necessary to operate the system with a sufficiently high exhaust temperature so as to avoid condensation of the corrosive constituents of the effluent at or near the exhaust end of the system. High exhaust temperatures can be readily equated with reduced efficiency. As an example, prior art systems may have a temperature adjacent the burner of 1000° F. and an exhaust temperature of 300° F.

The prevalent design principle of the industry is based on the assumption that a heating system must be designed for the worst case condition; i.e., the most extreme difference between outside air temperature and the desired temperature of the heated enclosure. In Detroit, for example, the average annual temperature is in the area of 40° F. and a heating system, on the average, must only be capable of producing a 25° temperature rise in order to produce comfortable temperatures of 65° F. for human inhabitants or to meet certain codes. However, the typical heating system is designed for an outside air temperature of −10° F. and is thus capable of an overall temperature increase of at least 80°. When such a system is activated or switched on the exhaust temperature is initially room temperature as all of the heat produced by the oxidation of fuel goes into heating up the physical components of the heating system. Since the heating system is substantially entirely within the enclosure, and ultimately gives up all of its heat to the enclosure, albeit not always effectively, the initial thermal efficiency of the activated system is near 100%. As the system heats up the exhaust temperature also goes up and more and more heat is simply thrown away at the exhaust end. Efficiency goes down correspondingly. The understanding of this relationship forms the basis for one aspect of the invention hereinafter described.

Another aspect of the invention involves the design of a control system, preferably of the type which includes a microprocessor with a programmable memory, for controlling a plurality of system operating parameters and sequencing certain events for maximum safety and effectiveness.

SUMMARY OF THE INVENTION

The invention hereinafter described pertains to the construction and operation of a low intensity infrared radiant energy system of the type which comprises an emitter tube and reflector combination which is located within the enclosure to be heated and which creates a directionalized emission of energy through the conveyance of a hot gaseous effluent from a one or more fuel fired burners through the emitters and ultimately to a location where it is exhausted outside of the enclosure. The word "burner" is to be construed to refer to a device which comprises a combustion chamber in which a mixture of air and fuel, such as natural gas, propane, LPG or fuel oil, is ignited and the effluent thereof is caused by means of pressure differential to flow into and through the emitter tube.

According to a first aspect of my invention a low intensity radiant energy heating system of the type generally described above is operated in such a way that a heat command may start the burner but an efficiency command based on a temperature measured at or near the exhaust may limit running time to something less, at least in one cycle, than a running time which can achieve the heat command target temperature. In general I intend this to mean that while the burner or set of burners in a given system are turned on by a signal from a room temperature thermostat system, burner operating time is subject to primary control by an instrumentality for detecting the exhaust effluent temperature, equating this temperature to a selected efficiency value, and deactivating the burner for a predetermined time period thereby to reduce exhaust effluent temperature upon restart despite the fact that the room temperature control system calls for additional heat.

In accordance with a second aspect of my invention hereinafter described, a low intensity, infrared emitting heating system is provided comprising two thermostatic control means. One of the thermostatic control means is operative to activate the burner or burners of the low intensity radiant energy heating system when a heat command is produced and another temperature control system is operative to deactivate the burner or burners when exhaust effluent temperature reaches a level beyond which unacceptable efficiency reduction would occur. In the preferred embodiment, thermal inertia is preferably kept quite low through the proper selection of construction materials including a light-gage emitter tube of weight-to-surface area ratio of about unity or less as hereinafter described.

In accordance with still another aspect of my invention, an infrared heating system of the type employing at least one fuel-fired burner and an elongate emitter tube receiving effluent from the burner is provided with a minimum run timer which is operatively associated with thermostatic controls and the like to override such controls thereby to ensure that each operating cycle of the burner or burners is long enough to clear corrosive condensates out of the primary length of the emitter tube even if input signals based on thermostatic or efficiency-oriented considerations call for burner shut-off prior to the expiration of the minimum run time. Of course, the minimum run timer must be itself subject to being disabled or over-ridden by safety-related factors and interlocks.

The minimum run timer may be used in combination with an efficiency-raising exhaust unit which reduces actual exhaust temperatures to a point below condensation temperature as hereinafter described.

In accordance with still another aspect of my invention, I provide a programmable controller, preferably including a microprocessor, for establishing an operating sequence including, as examples; multiple burner start sequence, and day-night output shift.

DETAILED DESCRIPTION OF THE SPECIFIC EMBODIMENTS

Figure 1:
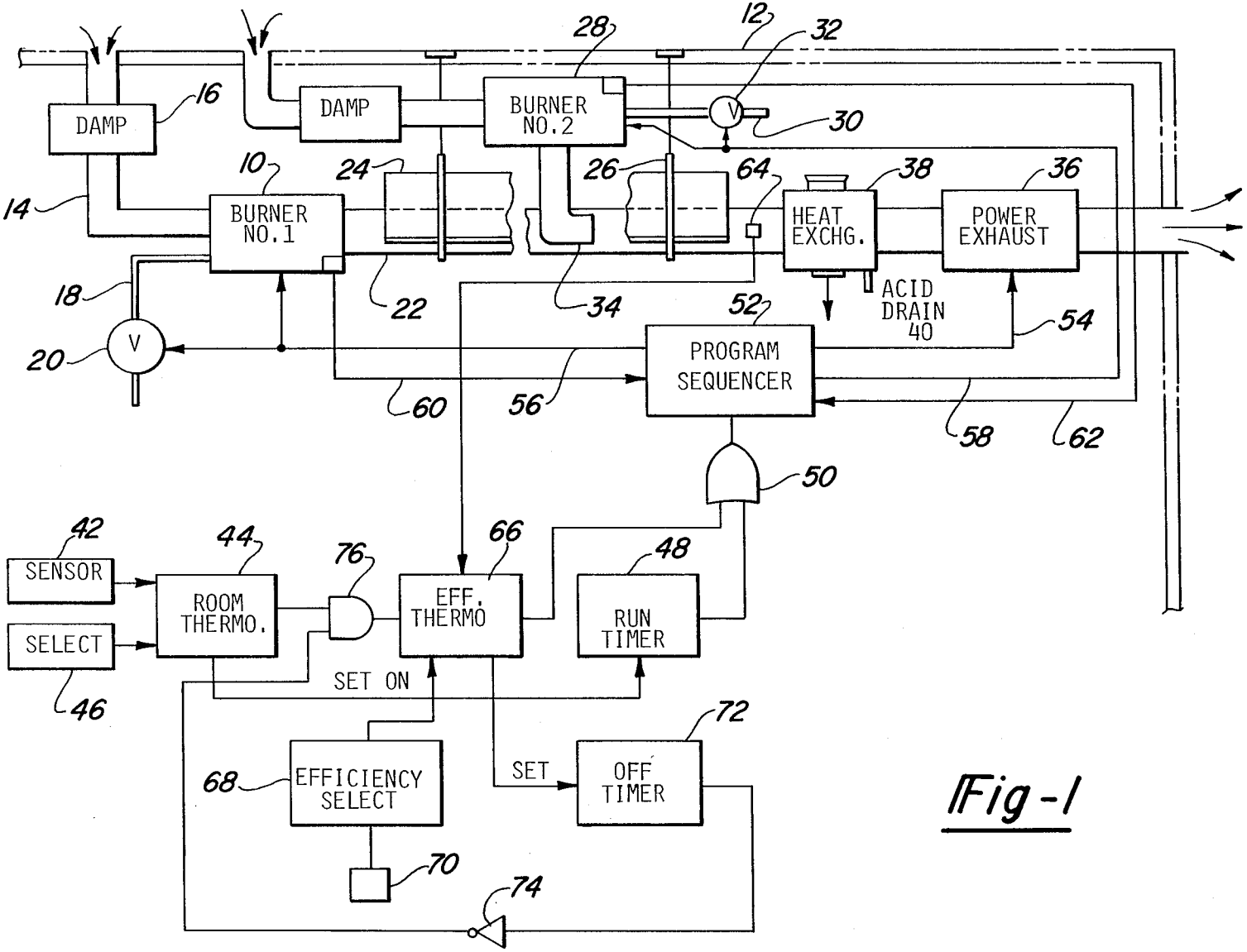
FIG. 1 is a schematic diagram of a system illustrating the dual thermostatic control system and the minimum run timer of the present invention.

Referring now to the drawing, FIG. 1 shows a low intensity radiant energy heating system comprising a gas fired burner 10 located within an enclosure defined by insulated outer walls 12 of a commercial building. The burner is connected through conduit 14 and adjustable damper 16 to the outside of the enclosure to provide air for combination with natural gas supplied to the burner through line 18. Valve 20 may be opened and closed by means of an external electrical control signal to emit gas at line pressure to the burner 10 on demand.

The hot gaseous effluent which is produced by the burner 10 is admitted to the input end of a length of emitter tube 22 which is preferably constructed of light gage spiral-wrapped, mechanically seam-joined, aluminized or coated steel having low thermal inertia and high resistance to corrosion. The length of the tube 22 may vary greatly with the particular installation and, by way of example, the nominal diameter of the tube may be from 2½ to 14 inches. The metal of the tube is preferably from 22 to 31 gage, yielding a weight-to-surface area ratio of one or less. This results in low thermal inertia in the emitter, i.e., heat up and cool down times are short. In contrast, heavy gage welded steel pipes used in prior art systems have a weight-to-surface area ratio of 3 to 6.

Over substantially the entire working length of the emitter tube 22 and in spaced and partial surrounding relationship to the tube 22 is a reflector 24 which directs radiant energy from the tube 22 toward the floor of the building 12. Hangers 26 are suspended from the ceiling of the building 12 to hold the combination of the tube 22, the burner 10 and the reflector 24 in place.

A second burner 28 is spaced downstream of burner 10 and arranged to burn a combination of gas supplied via line 30 and valve 32 and to emit a hot effluent via outlet tube 34 into emitter tube 22.

The tube 22 runs toward and through an exhaust fan 36 and a heat exchanger 38 having an acidic condensate drain or trap 40. The relatively cool effluent is vented to the atmosphere. The heat exchanger 38 is optional in the system, but where used is preferably constructed of materials such as plastic or stainless steel which are highly resistant to corrosion since the function of the heat exchanger is to remove heat from the tube 22 toward the exhaust end and direct it back into the building 12. This function necessarily cools the gaseous effluent in the tube 22 preferably to a temperature below the condensation point. Accordingly an acid drain or trap 40 is necessary so that the condensate may be safely and quickly eliminated from the system. In addition, it is desirably to pitch the cool portion of the system to ensure a flow of condensate to the trap/drain 40.

The exhaust fan 36 is also preferably constructed of corrosion resistant materials such as stainless steel.

A first temperature sensor 42 is located within the building 12 to sense air temperature and to provide a signal to a room temperature control module 44. A temperature selector 46 is also provided to permit the occupants of the building 12 to select a desirable target or reference room temperature. The controller 44 provides a "set on" signal to a minimum run timer 48 the output of which is connected through OR gate 50 to a programmable sequencer 52 which has outputs 54, 56 and 58 connected to the exhaust fan 36, the gas valve 20 and the igniter system of the burner 10 and the valve 32 and ignitor of burner 28 to activate the fan 36 and the burners insequence when a heat command is received via gate 50. The run timer 58 establishes a minimum operating time which is normally sufficient to clear the system of corrosive condensate; for example, eight minutes. Sequencer 52 also receives inputs from air flow switches in burners 10 and 28 via lines 60 and 62, respectively.

A second temperature sensor 64 is located in or near the exhaust effluent outlet and is connected to a second thermostatic controller 66 which is effiency driven rather than room temperature driven. The efficiency setting may be established by unit 68 which can either be manual or automatically operated. In the latter case, the unit 68 may further include an outside air temperature sensor 70 which effectively bypasses the controller 66 under extreme outside air temperature conditions. The unit 66 provides a "set" signal to an off timer 72 to deactivate the burners 10 and 28 whenever the exhaust effluent temperature reaches a level which is correlated with the minimum acceptable operating efficiency level of the system set by or through unit 68. This is achieved by connecting the output of timer 72 through an inverter 74 to one input of an AND gate 76 connected between unit 44 and unit 66. The timer 72 has a time-out period of about four minutes and is set according to the thermal inertia (i.e., cool-down time) of the emitter tube 22. For this reason it is preferable to use a light gage, low-inertia material for tube 22. The preferred material is a 22-gage aluminized steel which is spiral-wrapped into tube-configuration and mechanically crimp-seamed rather than welded. Galvanized and coated steels can also be used. The outputs of the controller 66 and the run timer 48 are connected through OR gate 50 to the sequencer 52 to generate an enable signal as long as either timer 48 or controller 66 calls for more heat.

The net result under normal non-extreme operating conditions is to recycle the heating system more frequently than would be the case for systems operating without the efficiency driven control unit 40. More importantly the result is a substantial increase in efficiency.

Figure 2:
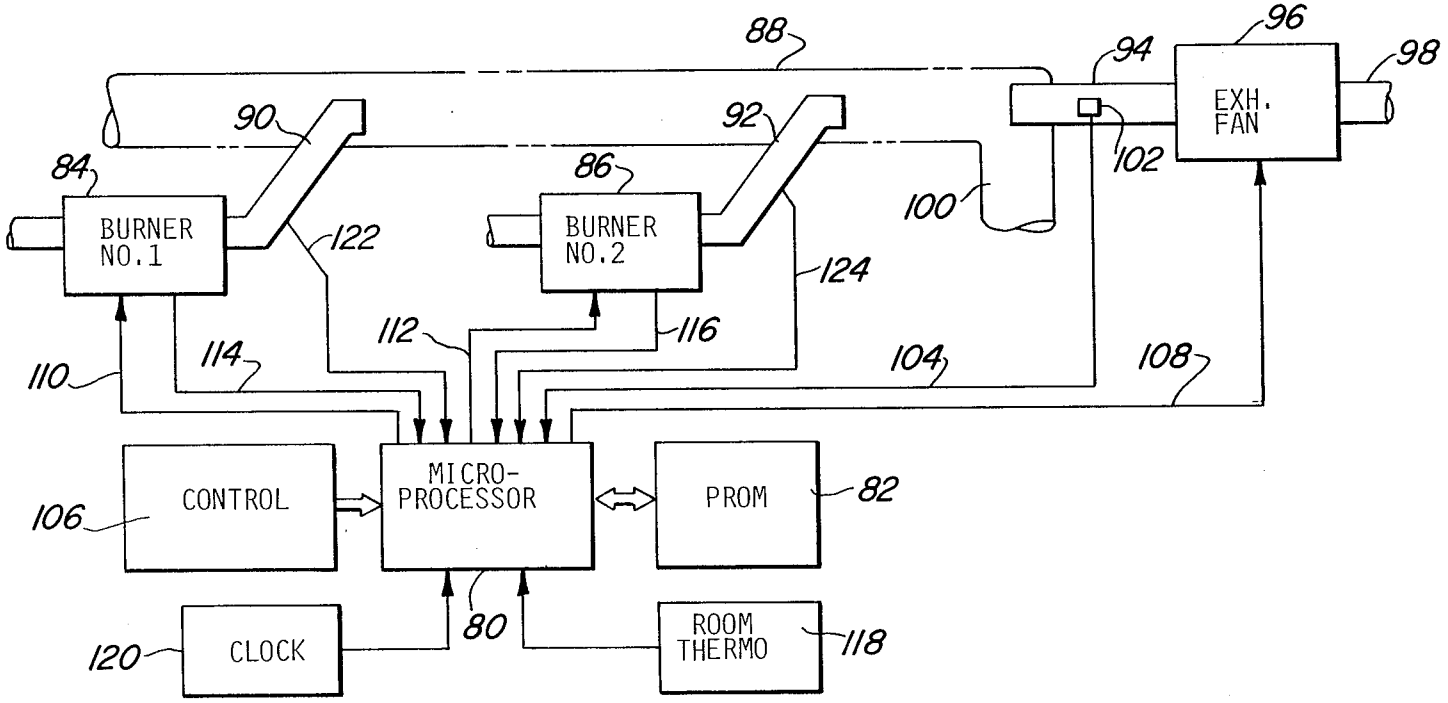
FIG. 2 is a alternative embodiment utilizing a microprocessor having a programmable memory.

Looking now to FIG. 2, a preferred multiple burner system utilizing a microprocessor 80 and a programmable read-only memory (PROM) 82 is shown. Gas fired burners 84 and 86 charge a light gage spiral-wrapped large diameter emitter tube 88 with hot gaseous effluent through injector nozzles 90 and 92, respectively. Although shown adjacent one another, the burners 84 and 86 are preferably located a substantial distance apart in the overall effective length of emitter tube 88 as is hereinafter made more clear. It is to be understood that burners 84 and 86 include gas lines with appropriate valves as was described in more detail with reference to FIG. 1 and, in addition, receive outside air for combustion purposes through appropriate conduit.

The system of FIG. 2 further includes an exhaust conduit 94 communicating with the emitter tube 88 and connected through an exhaust fan 96 to a vent conduit 98 which is preferably connected to a point outside of the heated enclosure so as to vent products of combustion to the atmosphere. A leg 100 of the large diameter emitter tube 88 extends beyond the exhaust tube 94 to indicate that the tube 88 may close back upon itself in the fashion of a loop thereby to recirculate part of the effluent therein as is more fully described in the copending application, Ser. No. 860,901, filing date 5-8-86, filed contemporaneously herewith in the name of Arthur C. W. Johnson. In this case the burners 84 and 86 are preferably located at halfway points around the loop. If additional burners are utilized, they are preferably relatively uniformly spaced.

An exhaust temperature sensor 102 is associated with tube 94 and is connected by way of line 104 to an input of microprocessor 80.

A control module 106 is associated with the microprocessor 80 and comprises a plurality of switches, dials, knobs or other conventional instrumentalities for inputting various commands to the microprocessor 80 to act as variables in a sequence stored in the memory 82 as hereinafter described. For example, controller 106 is utilized to select room temperature, maximum exhaust temperature, day/night setback or set forwrad or other operating parameters.

Microprocessor 80 comprises an output line 108 connected to activate the exhaust fan 96, an output 110 to activate burner 84 and an output 112 to activate burner 86. Microprocessor 80 receives an airflow signal from burner 84 by way of input line 114 and a similar airflow signal from burner 86 by way of input line 116. It is to be understood that each of the burners 84 and 86 has associated therewith a conventional airflow indicator switch capable of providing a low voltage signal on the associated lines 114 and 116 when the switches clock to indicate the proper flow of air through the respective burner.

Finally, a room thermostat 118 is connected as in input to microprocessor 80 and a clock 120 supplies fixed frequency signals to the counter portion of the microprocessor 80 to establish the various time intervals which are required to permit the microprocessor 80 and the associated memory 82 to function as a 7-day, 14-day or other selected interval programmable thermostat system.

Describing now a typical sequence of operation, references to be taken to FIG. 2 which is the preferred commercial embodiment of an electronic thermostat system for an infrared radiant energy heating system. With power applied to the system and a temperature command input to the microprocessor 80 by way of controller 106, the microprocessor 80 together with the memory 82 initiates a sequence of control functions, the first of which is to energize the exhaust fan 96 for a pre-purge period set by memory 82 and monitored by counting signals from clock 120. After an appropriate interval, the microprocessor looks at the inputs on lines 114 and 116 from the burners 84 and 86 respectively to establish that necessary flow of combustion air has occurred and that no blockage or other malfunction in the system exists to present an unsafe operating condition. If both airflow switch signals are present, microprocessor 80 then advances to the next step which is to activate burner 84 by way of output line 110. An optical signal or heat-sensing signal may be provided on line 122 by means of a suitable transistor and input to the microprocessor 80 to show that the burner 84 satisfactorily ignited. If this test is passed, output 112 is activated to ignite burner 86 and a similar test signal is generated on line 124 and input to the microprocessor 80.

As was described with reference to FIG. 1, a minimum run time is preferably established utilizing signals from the clock 120 and a sub-routine in memory 82. If any of the aforementioned input signals is not received, memory 82 recycles the program in an effort to start the system a second or a third time. If several no-start cycles occur, a count of same may be maintained to set the system down and activate an alarm.

When the room thermostate 118 inputs a signal to microprocessor 80 to indicate that the target temperature set by control 106 has been reached and the minimum run time interval has been met or exceeded, burners 84 and 86 may be deactivated, either fully or proportionally according to the system implementation. A post-purge interval is set in the program in memory 82 and causes the exhaust fan 96 to run beyond any full system shutdown.

The previously described program sequence is general in character and various additions and modifications thereto will occur to a person skilled in the art.

What is claimed is:

1. A method of heating an enclosure with a heating apparatus of the type having an infrared emitter within the enclosure and in the form of a tubular conduit for hot gaseous effluent and a burner connected to the conduit to charge the conduit with hot gaseous effluent when activated comprising the steps of:

(a) monitoring the temperature of the enclosure;

(b) activating the burner to charge the tubular emitter when the enclosure temperature is below a reference temperature;

(c) monitoring the temperature of the effluent at the exhaust end of the conduit; and (d) deactivating the burner when the exhaust temperature reaches a predetermined set value.

2. The method described in claim 1 including the further step of maintaining the burner in a deactivated condition for a predetermined period of time related to the thermal inertia of the heating system.

3. The method of claim 1 wherein the step of activating the burner is carried out for a preset and non-variable minimum time period.

4. A radiant energy heating system of the type which comprises an infrared emitter in the form of a tubular conduit for hot gaseous effluent, said conduit having an input end and an exhaust end and being mounted within an enclosure to be heated, and a burner connected to the input end of the emitter tube to charge the emitter tube with hot gaseous effluent when activated, wherein the improvement comprises:

a first thermostatic control means for activating the burner in response to the temperature of the enclosure; and a second thermostatic control means for deactivating the burner in response to a predetermined increase in the temperature of the exhaust effluent.

5. Apparatus as defined in claim 4 further including first timing means for maintaining the activated state of the burner for a set predetermined minimum time irrespective of said exhaust effluent temperature.

6. Apparatus as defined in claim 5 further including a second timer for maintaining the deactivated state of the burner for a set predetermined minimum time related to the thermal inertia of the emitter tube.

7. Apparatus as defined in claim 4 further including means for selecting the temperature of the exhaust effluent at which the burner is deactivated.

8. Apparatus as defined in claim 4 further including insulative reflector means disposed in partially surrounding relationship proximate at least a portion of the operating length of the emitter tube.

9. Apparatus as defined in claim 4 further including power exhaust means connected to the output end of the emitter tube to pull effluent therethrough.

10. Apparatus as defined in claim 4 wherein the emitter tube is constructed of low thermal inertia, light gage, spirally wrapped metal tubing having a weight-to-surface area ratio of about one or less.

11. Apparatus as defined in claim 4 further including programmable microprocessor means connected to receive signals from said first and second thermostatic control means for directly activating and deactivating said burner.

12. In a radiant energy heating system of the type having a burner, an elongate tubular infrared emitter of metallic construction receiving effluent from the burner, and a thermostatic control system for turning the burner off and on according to heat demands, the improvement which comprises a minimum burner run timer connected to said burner to maintain the burner in an "on" condition until a predetermined effluent exhaust temperature sufficient to maintain corrosive substances in a gaseous state is reached regardless of heat demand signals from said control system.

13. A radiant energy infrared heating system comprising:

a tubular infrared emitter;

first and second burners for introducing hot gaseous effluent into said tubular emitter at spaced points; and a programmable means including a microprocessor and an associated memory for activating said first and second burners at different times in a time sequence established by a program stored in said memory.

14. Apparatus as defined in claim 13 further including an exhaust fan for venting effluent from said emitter tube, said microprocessor being connected to activate and deactivate said exhaust fan, and means for preventing the activation of said first and second burners by said microprocessor until signals are received from said burners indicating the flow of air therethrough after activation by said microprocessor of said exhaust fan.

15. Apparatus as defined in claim 13 further including a thermostat for producing signals representing temperature of an enclosure within which said emitter tube is located, said thermostat being connected as an input to said microprocessor.

16. A method of operating a radiant energy infrared heating system comprising first and second burners for charging an emitter tube with hot gaseous effluent, and an exhaust fan for venting at least a portion of said effluent from said emitter tube wherein said method consists of the steps of:

activating said exhaust fan;

testing for the flow of combustion air through said burners during a first test interval; and thereafter, activating said first and second burners in sequence only if both burners positively test for airflow.

17. The method defined in claim 16 including the further steps of deactivating said burners but continuing to operate said exhaust fan for a post-purge period following the deactivation of said burners.

18. In a radiant energy heating system of the type having a burner, an elongate tubular infrared emitter of metallic construction receiving effluent from the burner, and a thermostatic control system for turning the burner on according to heat demands, the improvement which comprises:

(a) a minimum burner run timer connected to said burner to maintain the burner in an "on" condition until a first predetermined effluent exhaust temperature is reached; and (b) an effluent exhaust temperature sensor connected to the burner to turn the burner off when the effluent exhaust reaches a second predetermined temperature which is higher than the first predetermined temperature but only if the burner has been in the "on" condition long enough to time-out said minimum burner run timer.

* * * * *